US007131720B2

(12) United States Patent
Mizuno et al.

(10) Patent No.: US 7,131,720 B2
(45) Date of Patent: Nov. 7, 2006

(54) INKJET PRINTER AND MAINTENANCE METHOD THEREOF

(75) Inventors: Toru Mizuno, Nagoya (JP); Masahiko Sasa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 245 days.

(21) Appl. No.: 10/764,459

(22) Filed: Jan. 27, 2004

(65) Prior Publication Data

US 2004/0183876 A1 Sep. 23, 2004

(30) Foreign Application Priority Data

Feb. 4, 2003 (JP) ..... 2003-027525

(51) Int. Cl.
*B41J 2/19* (2006.01)
*B41J 2/175* (2006.01)

(52) U.S. Cl. ..... 347/92; 347/23; 347/29; 347/30; 347/32; 347/33; 347/86

(58) Field of Classification Search ..... 347/22–35, 347/85, 17, 86, 926
See application file for complete search history.

(56) References Cited

U.S. PATENT DOCUMENTS 6,290,343 B1 * 9/2001 Lewis et al. ..... 347/85
6,742,877 B1 * 6/2004 Usui et al. ..... 347/85

FOREIGN PATENT DOCUMENTS

JP 404070351 A * 3/1992 ..... 347/92
JP B2 2703647 10/1997
JP A 10-138506 5/1998

* cited by examiner

*Primary Examiner*—Shih-Wen Hsieh
(74) *Attorney, Agent, or Firm*—Oliff & Berridge, plc

(57) ABSTRACT

In a maintenance method of an inkjet printer comprising an air discharge device which discharges air accumulated in ink supply paths with pressurized air and an ink vacuum device which vacuums ink from an inkjet head, the pressurized air is in a high pressure mode when the air discharge device is used. The pressurized air is in a low pressure mode when the ink vacuum device is used. The driving time and the rotational speed of a drive motor which drives an air pump are controlled according to the capability and the ambient temperature of the air pump which generates the pressurized air.

17 Claims, 14 Drawing Sheets

INKJET PRINTER AND MAINTENANCE METHOD THEREOF

BACKGROUND OF THE INVENTION (1) Field of the Invention

This invention relates to an inkjet printer and a maintenance method thereof. It specially relates to a technique of discharging air accumulated in supplying paths of ink and to a cleaning technique of a printing head.

(2) Background Art

Various inkjet printers which can print texts and images with plural colors of ink supplied from ink cartridges of plural colors have been used.

In order to give positive pressure to ink, some types of ink cartridges, wherein ink is supplied through tubes, are constituted to reserve ink in bags made of thin films in ink reservoirs, to have air chambers outside of the bags and to supply pressurized air into the air chambers.

An air supply system which generates this pressurized air has an air pump, a drive motor which drives the air pump, an air tube extending from the air pump, plural branched-paths branched from the air tube to plural ink cartridges and a pressure regulator, a relief valve or an orifice connected to the air tube in the vicinity of the air pump for pressure adjustment.

For example, Sato et al (Japanese Patent No. 2703647) discloses an inkjet printer comprising such an air supply system described as above constituted with a relief valve for pressure adjustment an air temperature sensor which detects air temperature and a pressure sensor which detects pressure of pressurized air in an air tube. It discloses an art to correct driving voltage for driving a pump driving motor according to air temperature detected by the air temperature sensor when pressurized air is to be generated before or after an usage of the printer.

Kumagai (Unexamined Japanese Patent Publication No. 10-138506) discloses an inkjet recording apparatus comprising an air supply system described as above having a pressure regulator and changeover valves inserted in branched-paths disposed therein.

These kinds of air supply systems have been used to vacuum ink from nozzles to clean nozzles of printing heads. In other words, these kinds of air supply systems have been used to facilitate ink vacuum by increasing pressure on ink when au ink vacuum from nozzles is conducted.

However, if the pressure on ink applied with these kinds of air supply systems is too high when an ink vacuum from nozzles of an inkjet printer is conducted, ink leaks unnecessarily. If the pressure is too low, on the other hand, ink vacuum cannot be sufficiently conducted.

These air supply systems described above can be also used to discharge air accumulated in ink supply paths. Accumulated air can be discharged by opening some parts of the ink supply paths temporary while the ink supply paths are pressurized by the air supply system.

However, if the pressure on the ink supply paths applied by the air supply system is not enough to discharge air accumulated in the ink supply paths, air cannot be discharged sufficiently. Moreover, it takes longer to discharge air. On the other hand, if the pressure of pressurized air is too high, ink leaks unnecessarily from an air vent, and noise generated by the air supply system becomes louder.

Generally, appropriate air pressure applied to vacuum ink is mainly to prevent a destruction of a meniscus when a vacuum cap is removed from a head, and is lower than appropriate air pressure for an air discharge from ink supply paths. If air pressure generated by an air supply system is set appropriately for an ink vacuum, the air pressure is not enough for an air discharge and air cannot be discharged sufficiently. Contrary, if air pressure generated by an air supply system is set appropriately for an air discharge, the air pressure becomes so high that it causes an unnecessary ink leakage when ink is vacuumed.

Moreover, the pressure of pressurized air generated by the air supply system and flow rate thereof, vary depending on environmental temperature and variations in characteristics of air pumps constituting the air supply systems. These variations sometimes cause problems described above when an ink vacuum and an air discharge from ink supply paths are conducted.

This invention was made in consideration of above described issues, and one of its purposes is to provide an inkjet printer wherein unnecessary ink leakage does not occur when an ink vacuum from nozzles of a printing head and a discharge of air accumulated in ink supply paths are conducted, wherein an ink vacuum and an air discharge can be sufficiently conducted, and wherein noise generated by an air supply system is reduced, and to provide a maintenance method of such inkjet printer.

SUMMARY OF THE INVENTION

To attain this and other objects, the inkjet printer of the present invention comprises ink cartridges which reserve ink supplied to an inkjet head, and a pressurized air generating device which generates pressurized air supplied to the ink cartridges. The pressurized air generating device comprises a high pressure mode to generate pressurized air at predetermined pressure P1, and a low pressure mode to generate pressurized air at pressure P2 which is lower than the pressure P1.

In the present invention, the pressurized air generating device is set to be in the high pressure mode, for example, to generate pressurized at pressure P1 so that the pressurized air can be used to discharge air accumulated in ink supply paths. In this case, the air pressure applied to the ink supply paths is high enough to discharge air sufficiently.

The pressurized air generating device is set to be in the low pressure mode, for another example, to generate pressurized air at pressure P2 so that the pressurized air can be used to vacuum ink from a printing head. In this case, the air pressure is at a constant pressure and not too high. Hence, ink does not leak from the printing head unnecessarily.

As described above, in the present invention, the pressurized air generating device can generate two types of pressurized air, i.e. high air pressure and low air pressure. Appropriate air pressure can be applied respectively, for example, for discharging air accumulated in the ink supply paths and for vacuuming ink from the printing head.

Therefore, insufficient air discharge from the ink supply paths or unnecessary ink leakage in an ink vacuum does not occur.

The inkjet printer preferably further comprises art air discharge device which discharges air accumulated in the ink supply paths with the pressurized air, and an ink vacuum device which vacuums the ink from the inkjet head with the pressurized air. When the air discharge device is used, the pressurized air generating device is in the high pressure mode. When the ink vacuum device is used, the pressurized air generating device is in the low pressure mode to pressurize the ink.

Since the pressurized air at high pressure P1 is used when the air discharge device is used, air accumulated in the ink supply paths can be discharged sufficiently.

The pressurized air at low pressure P2 is used when the ink vacuum device is used. Consequently, the ink does not leak from the printing head unnecessarily.

As described above, because the pressurized air generating device can generate two types of pressurized air, i.e. high air pressure and low air pressure, appropriate air pressure can be applied respectively for discharging air accumulated in the ink supply paths and for vacuuming the ink from the printing head.

The air discharge device of the inkjet printer is preferably used while the pressurized air generating device is operated.

In the inkjet printer, when the air discharge device is used, the ink supply paths are already pressurized by the pressurized air generating device. Consequently, air does not enter the ink supply paths of the printing head from outside, or the ink discharged from the ink supply paths to outside (to the paths to discharge the air accumulated in the ink supply paths) and mixed with inks of other colors does not go back to the ink supply paths.

In usage of the ink vacuum device, the ink is preferably pressurized by the pressurized air generating device at least by the time when a vacuum of the ink is terminated.

Thereby, the ink does not enter the nozzles of the printing head (the ink does not disappear from the vicinities of outlets of nozzles) when vacuum caps are removed from the printing head. Therefore, a printing can be always conducted normally after usage of the ink vacuum device.

The pressurized air generating device is preferably constituted with an air pump and a drive motor which drives the air pump. When the air discharge device is used, the rotational speed of the drive motor is kept at a constant speed and the driving time of the drive motor is controlled according to the capability of the air pump.

The rotational speed of the drive motor does not become excessive, while the rotational speed of a drive motor becomes too fast in a method wherein the rotational speed of a drive motor is changed according to variations in the ambient temperature and capability of the air pump. Therefore, noise generated by the drive motor can be reduced.

Furthermore, if the capability of the air pump is low (for example, the air pressure generated by predetermined rotational speed is low), the driving time can be set long. In contrast, if the capability of the air pump is high, the driving time can be set short. Thereby, the amount of the air discharged by the air discharge device (and the amount of the ink discharge with the air) can be certain amount.

The capability of the air pump can be obtained based on the correlative characteristic between the rotational speed of the drive motor and the air pressure generated by the air pump.

The correlative characteristic between the rotational speed of the drive motor and the air pressure generated by the air pump can be measured in advance (for example, before the drive motor is installed in the inkjet printer). The result can be used for controlling the driving time of the drive motor.

The driving time is preferably furthermore controlled according to ambient temperature of the air pump.

Generally, the air pressure generated by an air pump changes according to changes in the ambient temperature of the air pump. However, in the present invention, the driving time is controlled according to the ambient temperature of the air pump. The amount of air discharged by the air discharge device can be certain amount even when the ambient temperature of the air pump changes.

The rotational speed of the drive motor is preferably controlled according to the capability of the air pump when the ink vacuum device is used.

Thereby, when the ink vacuum device is used, the most appropriate air pressure can be applied to the ink supply paths.

In case of an inkjet printer wherein air pressure generated by an air pump is not controlled according to the capability of the air pump, ink does not get inflated from nozzles because of insufficient air pressure, or a large amount of ink leaks from the nozzles because of excessive air pressure. However, this does not occur in the inkjet printer with the aforementioned feature.

Therefore, the inkjet printer can conduct an ink vacuum appropriately and blockage of nozzles barely occurs.

The rotational speed is preferably furthermore controlled according to the ambient temperature of the air pump.

Generally, when the ambient temperature of an air pump changes, the air pressure generated by the air pump changes correspondingly. However, in the present invention, the air pressure generated by the air pump can be kept at a constant pressure despite of changes in the ambient temperature of the air pump because the rotational speed of the drive motor is controlled according to the ambient temperature of the air pump.

Therefore, the air pressure is at a constant pressure despite of changes in the ambient temperature of the air pump, and an ink vacuum can be always conducted appropriately.

The maintenance method of inkjet printer of the present invention comprises an air discharge process to discharge air accumulated in ink supply paths of the inkjet printer by using a pressurized air generating device constituted with an air pump and a drive motor which drives the air pump, and an ink vacuum process to vacuum ink from an inkjet head of the inkjet printer. When the air discharge process is conducted, the pressure of the pressurized air generated by the pressurized air generating device is set at predetermined pressure P1. When the ink vacuum process is conducted, the pressure of the pressurized air generated by the pressurized air generating device is set at pressure P2 which is lower than the pressure P1 to pressurize the ink.

According to the aforementioned method, in the air discharge process, the rotational speed of the drive motor is kept at a constant speed and the driving time of the drive motor is controlled according to the capability of the air pump.

BRIEF DESCRIPTION OF THE DRAWINGS

The invention will now be described below, by way of example, with reference to the accompanying drawings.

DETAILED DESCRIPTION OF THE PREFERRED EMBODIMENT

An embodiment of the inkjet printer and the maintenance method thereof of the present invention are described below by applying them to a multi-function apparatus having functions of a printer, a copier, a scanner, a facsimile and a telephone.

Figure 1:
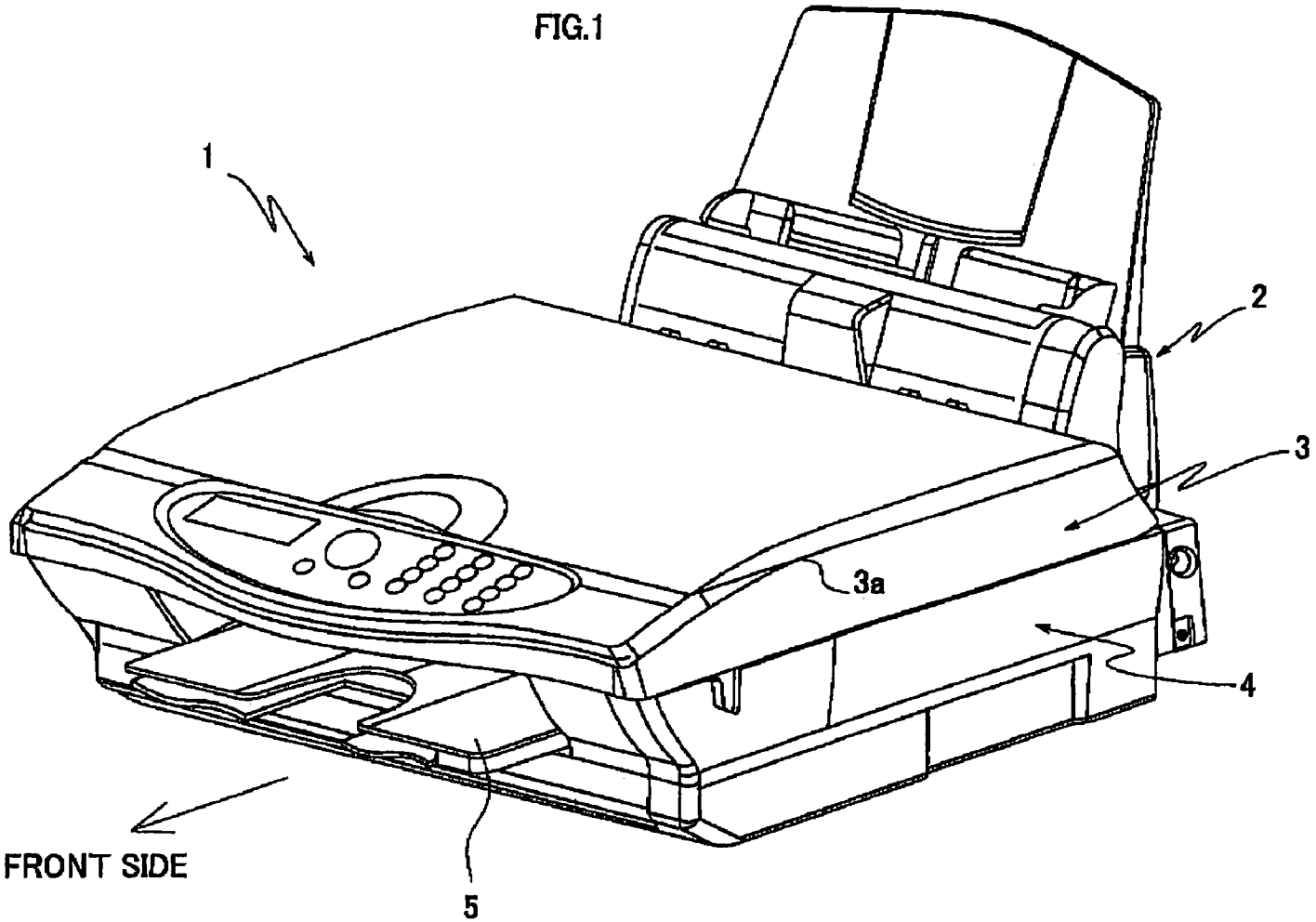
FIG. 1 is a schematic view showing the appearance of the multi-function apparatus of the embodiment according to the present invention.

Firstly, the following describes the overall structure of the multi-function apparatus of the present embodiment. As shown in FIG. 1, the multi-function apparatus 1 comprises a paper feeder 2 disposed at the rear end of the multi-function apparatus 1, an image reading device 3 disposed on the upper side of the portion in front of the paper feeder 2 for a copier function, an inkjet printer 4 disposed under the image reading device 3, and an output tray 5 disposed in the front side of the inkjet printer for printed paper.

The image reading device 3 is constituted to be vertically pivotable on a horizontal shaft disposed at the rear end (not shown in the drawing). The image reading device 3 has a glass plate which appears when a cover 3*a* is lifted up to be open to put an image thereon, and an image scanner under the glass plate for image reading. Replacement of ink cartridges 40 to 43 of the inkjet printer 4 and maintenance of a printing mechanism unit 10 can be done when the image reading device 3 is manually lifted up to be open. As shown in FIG. 1, the inkjet printer 4 is disposed in front of the paper feeder 2.

Secondly, the following describes the structure of the inkjet printer 4.

As shown in FIGS. 2 to 4 and 7, the inkjet printer 4 tis constituted with a printing mechanism unit 10 which prints with a printing head 23P on paper (for example, paper in A4 size or letter size) supplied from the paper feeder 2; a maintenance mechanism unit 11 which conducts a maintenance process of the printing head 23P; an ink supply unit 12 which supplies ink from the ink cartridges 40 to 43; and a pressurized air supply unit 13 which supplies pressurized air to the ink cartridges 40 to 43.

The printing mechanism unit 10 of the inkjet printer 4 is described by the following.

Figure 2:
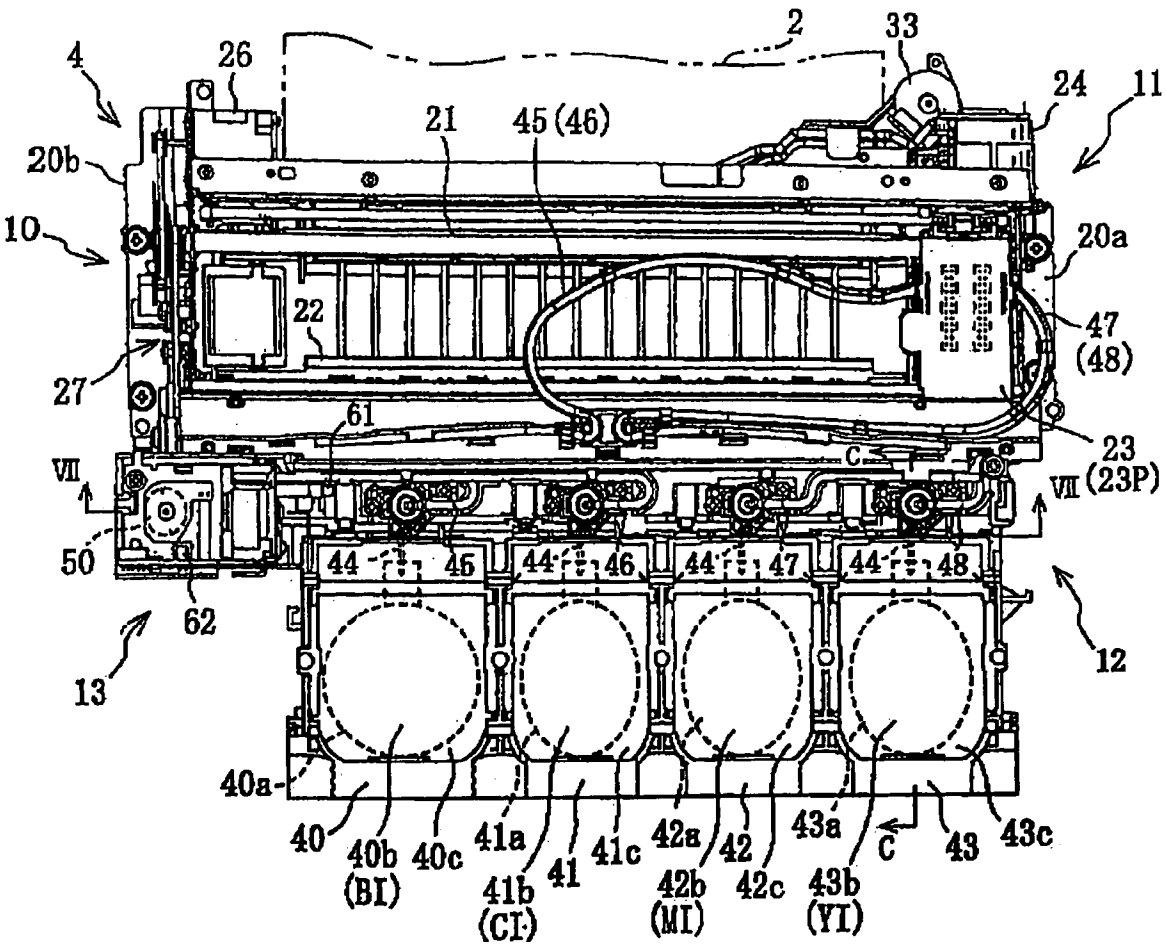
FIG. 2 is a plan view showing the structure of the inkjet printer of the embodiment.
Figure 4:
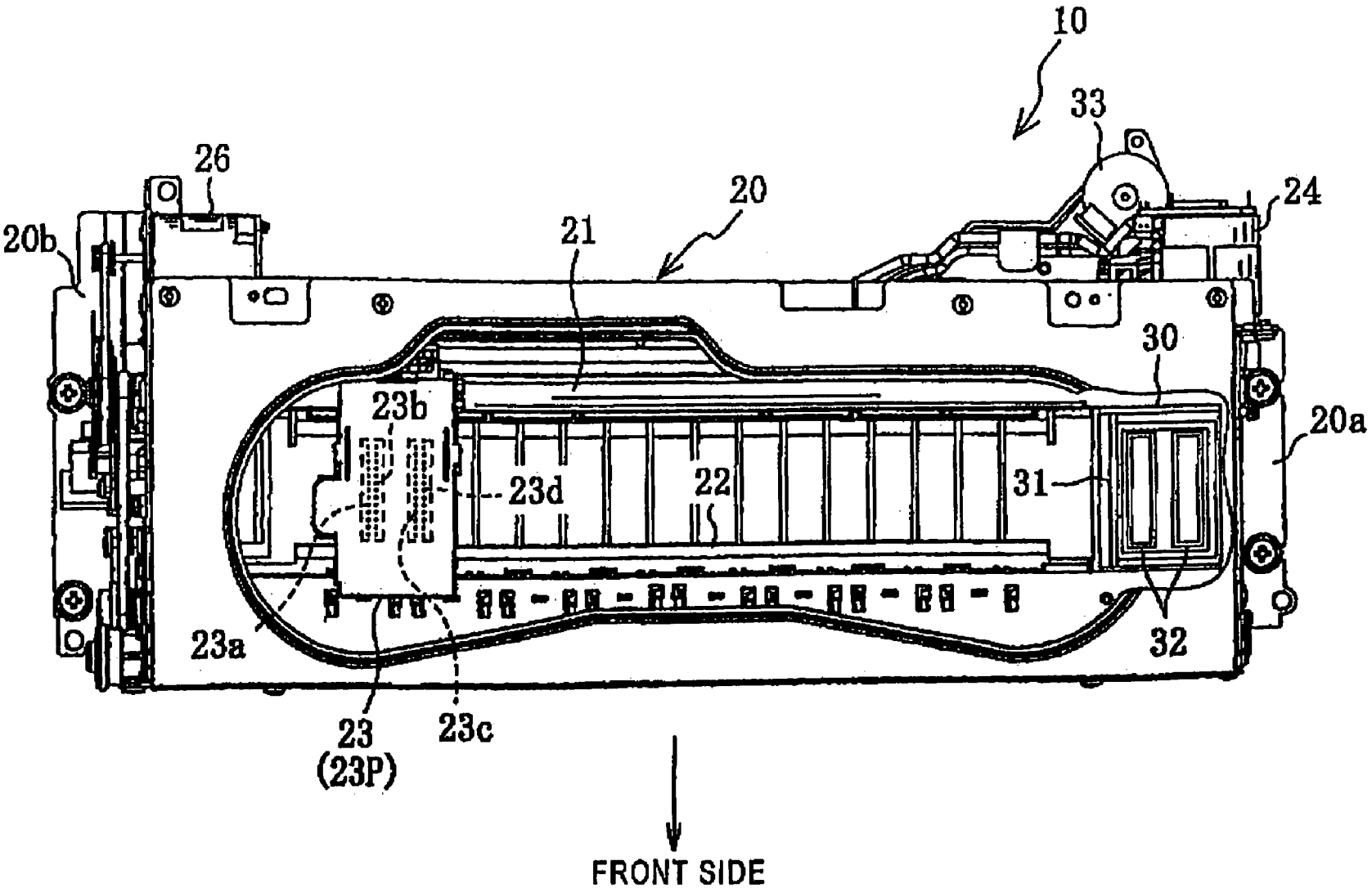
FIG. 4 is a plan view, with portions broken away for clarity, of the inkjet printer shown in FIG. 2.

The printing mechanism unit 10 is stored in a printing unit frame 20 which is in a flat-box shape including a reinforcement panel having an opening for paper to be accessible therefrom, as shown in FIGS. 2 and 4. Right and left ends of a guide shaft 21 and a guide rail 22, disposed respectively in the rear side of the frame 20 and in the front side of the frame 20, are fixed by a right wall 20*a* and a left wall 20*b*. A carriage 23 and the printing head 23P are guided and supported by the guide shaft 21 and the guide rail 22 in a manner to be movable from side to side. The carriage 23 and the printing head 23P can be driven to reciprocate from one side to another by a carriage drive motor 24 via timing belt along the guide shaft 21 and the guide rail 22. To be more precise, the carriage 23 is guided by the guide shaft 21 and the printing head 23P is guided by the guide rail 22 as the printing head 23P is fixed and connected to the fore end of the carriage 23.

As shown in FIGS. 2 and 4, four series of inkjet nozzles 23*a* to 23*d* corresponding to four colors of ink are disposed on the bottom surface of the printing head 23P. There are numbers of inkjet nozzles 23*n* (refer to FIG. 10) in each series of nozzle. The series of nozzles for black ink 23*a* and the series of nozzles for cyan ink 23*b* are aligned next to each other. The series of nozzles for magenta ink 23*c* and the series of nozzles for yellow ink 28*d* are aligned likewise. Each inkjet nozzle is driven by a piezoelectric actuator and jets drops of ink. The printing head 23P can be a printing head having a drive system utilizing heater element.

Figure 5:
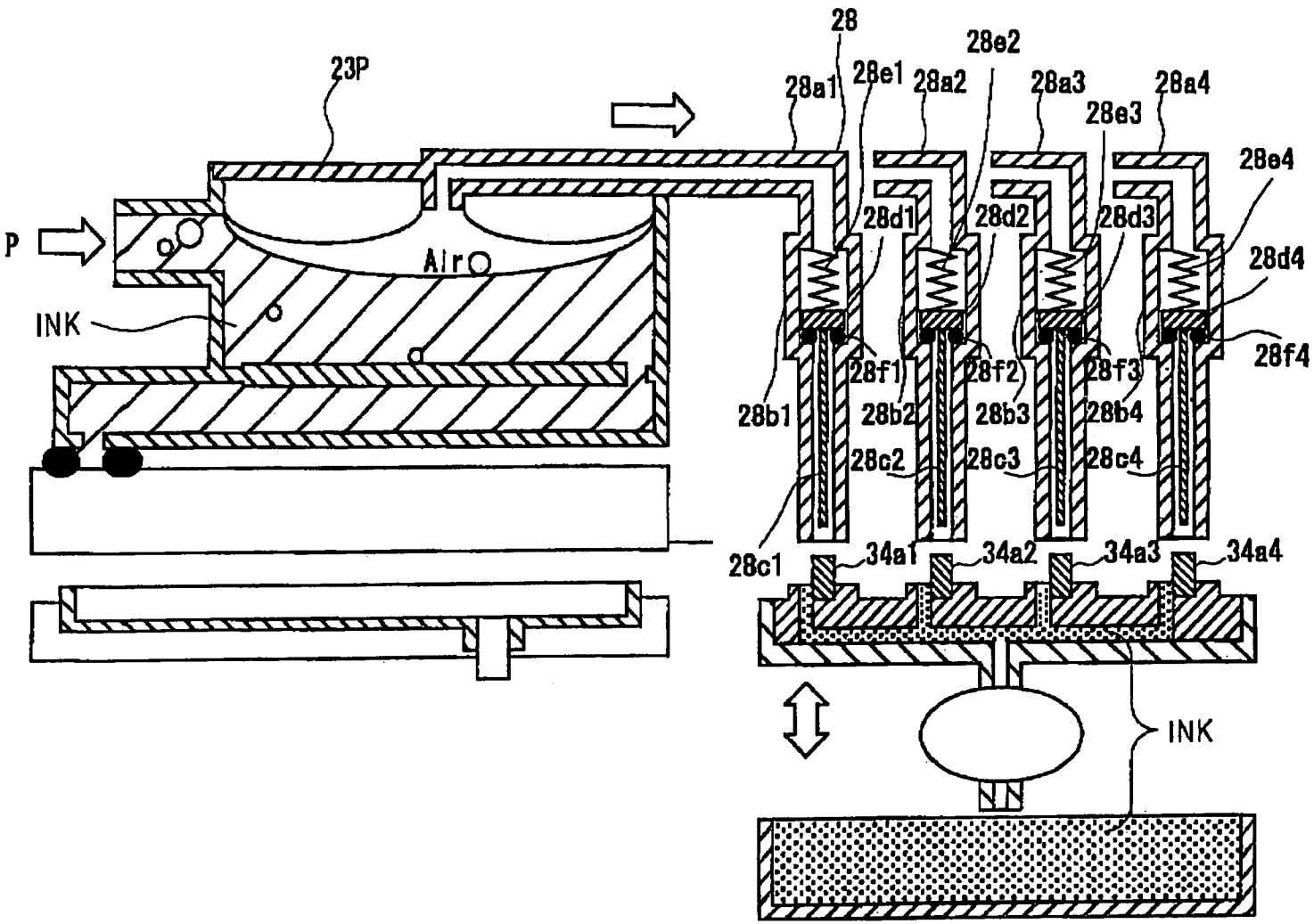
FIG. 5 is a schematic View showing the structure of the air discharge mechanism of the embodiment.

In the right side of the printing head 23P (the right side in FIG. 4), an air discharge mechanism 28 is disposed as shown in FIG. 5. This air discharge mechanism 28 comprises four air discharge pipes 28*a*1 to a4 respectively connected to paths of four colors of ink in the printing head 23P. In the air discharge pipes 28*a*1 to a4, shutoff valves 28*b*1 to b4 and valve rods 28*c*1 to c4 are respectively disposed. The shutoff valves 28*b*1 to b4 respectively open/close the air discharge pipes 28*a*1 to a4. The valve rods 28*c*1 to c4 respectively open/close the shutoff valves 28*b*1 to b4.

The shutoff valves 28*b*1 to b4 respectively close the air discharge pipes 28*a*1 to a4 when the valve rods 28*c*1 to c4 are lowered and upper portions of valves 28*d*1 to d4 are pressed by springs 28*e*1 to e4 against the lower portions of valves 28*f*1 to f4. The air discharge pipes 28*a*1 to a4 are opened when the valve rods 28*c*1 to c4 are respectively pushed up by release rods 34*a*1 to a4 of a maintenance mechanism 30 which is to be hereinafter described, the upper portions of valves 28*d*1 to d4 are consequently pushed up, and gaps are formed between the upper portions of valves 28*d*1 to d4 and the lower portions of valves 28*f*1 to f4.

The air discharge mechanism 28 constitutes an air discharge device with the maintenance mechanism unit 11 which is to be described hereinafter.

Under the guide shaft 21, a main conveying roller (a registration roller) 25 (refer to FIG. 3) is disposed and supported rotatably. The conveying roller 25 is rotated in a predetermined direction by a paper conveying motor 26 through a gear mechanism 27, moves paper fed from the paper feeder 2 generally horizontally beneath the printing head 23P, conveys paper in a conveying direction, i.e. toward the "front side" showing FIG. 4 and ejects paper onto the output tray 5.

The maintenance mechanism unit 11 of the inkjet printer 4 is briefly described by the following.

As shown in FIG. 4, a maintenance case 30 is disclosed in the right end side and in the vicinity of the bottom of the printing unit frame 20.

In this maintenance case 30, there are a wiper blade 31 constituted with thin rubber vertically disposed, and a pair of rubber head caps 32 disposed upward in the right side of the wiper blade 31. There are also four rod-like release rods 34*a*1 to a4 vertically disposed in the right side of the head caps 32.

The maintenance case 30 furthermore comprises a maintenance motor 33 which is a driving source of the wiper blade 31, the head caps 32, the release rods 34*a*1 to a4 and a vacuum pump (a tube pump) 200, and a drive mechanism constituted with a planet gear 35, gears 36 and 37 which transmit the driving force of the maintenance motor 33.

To the head caps 32, vacuum tubes communicating with the vacuum pump 200 through a switching valve 201 are connected. When the head caps 32 are pressed against the undersurface of the printing head 23P, ink can be vacuumed from nozzles 23*n* of the printing head 23P.

Figure 6:
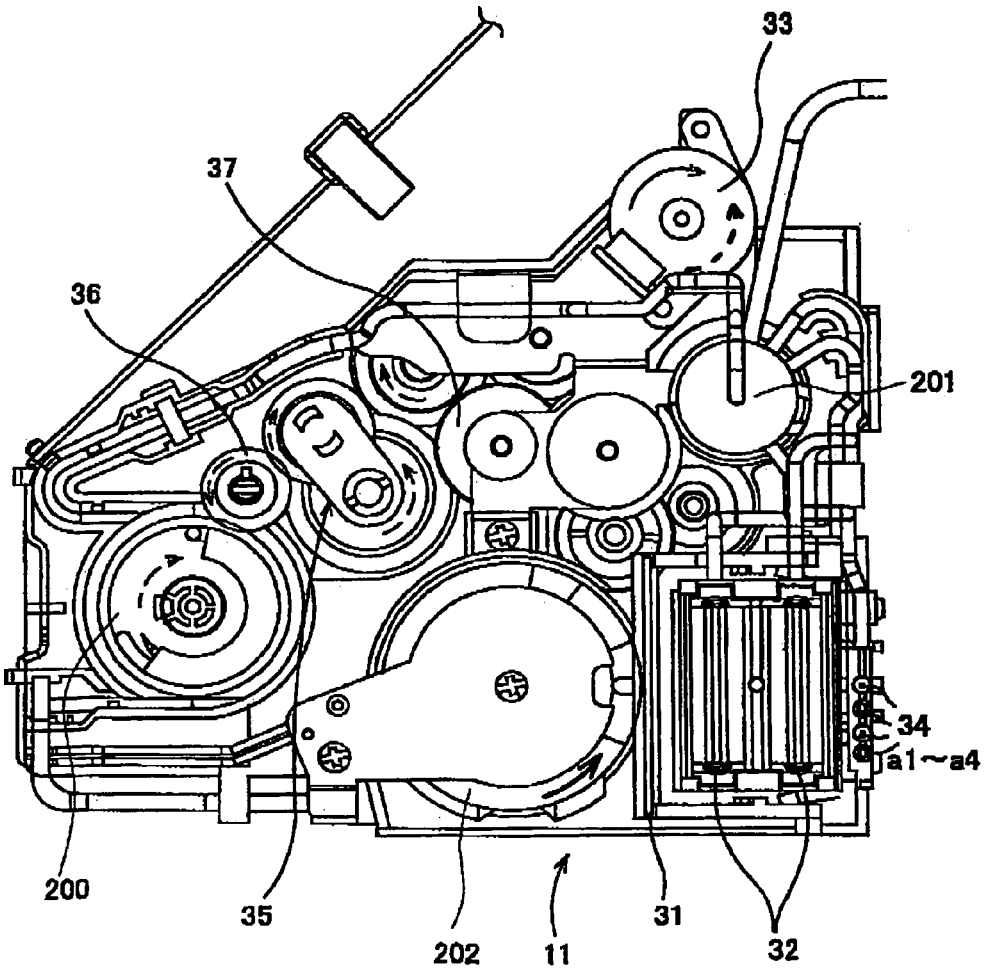
FIG. 6 is a schematic view showing the structure of the maintenance mechanism unit of the embodiment.

The driving force from the maintenance motor 33 is transmitted to the wiper blade 31, head caps 32 and release rods 34*a*1 to a4 while the planet gear 35 engages with the gear 37 in the drive mechanism. To be more precise, when the maintenance motor 33 normally rotates in the direction shown by an arrow with full line in FIG. 6 (the clockwise direction), the driving force is transmitted to the cam body 202 through the planet gear 35 and the gear 37. A cam body 202 consequently rotates in the counterclockwise direction. The wiper blade 31 is given vertical movement through a blade lifting mechanism. When the maintenance motor 33 furthermore normally rotates in the clockwise direction, the head caps 32 are given vertical movement through a cap lifting mechanism. When the maintenance motor 33 still furthermore normally rotates in the clockwise direction, the release rods 34*a*1 to a4 are given vertical movement through a release rod lifting mechanism. The switching valve 201 is operated corresponding to the clockwise rotation of the maintenance motor 33. The switching valve 201 is switched to a position to communicate the head caps 32 with the vacuum pump 200 when the head caps 82 are lifted up, and to a position to communicate the air discharge pipes 28*a*1 to a4 with the vacuum pump 200 when the lease rods 34*a*1 to a4 are lifted up.

On the other hand, the driving force from the maintenance motor 33 is transmitted to the vacuum pump 200 while the planet gear 35 engages with the gear 36. That is, when the maintenance motor 38 reversely rotates in the direction shown by an arrow with dotted line in FIG. 6 (in the counterclockwise direction), the driving force is transmitted to the vacuum pump 200 through the planet gear 86 and the gear 36. The vacuum pump 200 is driven to rotate in the direction shown by an arrow with dotted line (in the clockwise direction) corresponding to the rotation of the maintenance motor 33.

The wiper blade 31, the head caps 32, the maintenance motor 33 and the cap lifting mechanism constitute an ink vacuum device. The maintenance motor 33, release rod lifting device and release rods 34*a*1 to a4 constitute one part of the air discharge device.

The structure of the ink supply unit 12 of the inkjet printer 4 is described by the following.

Figure 3:
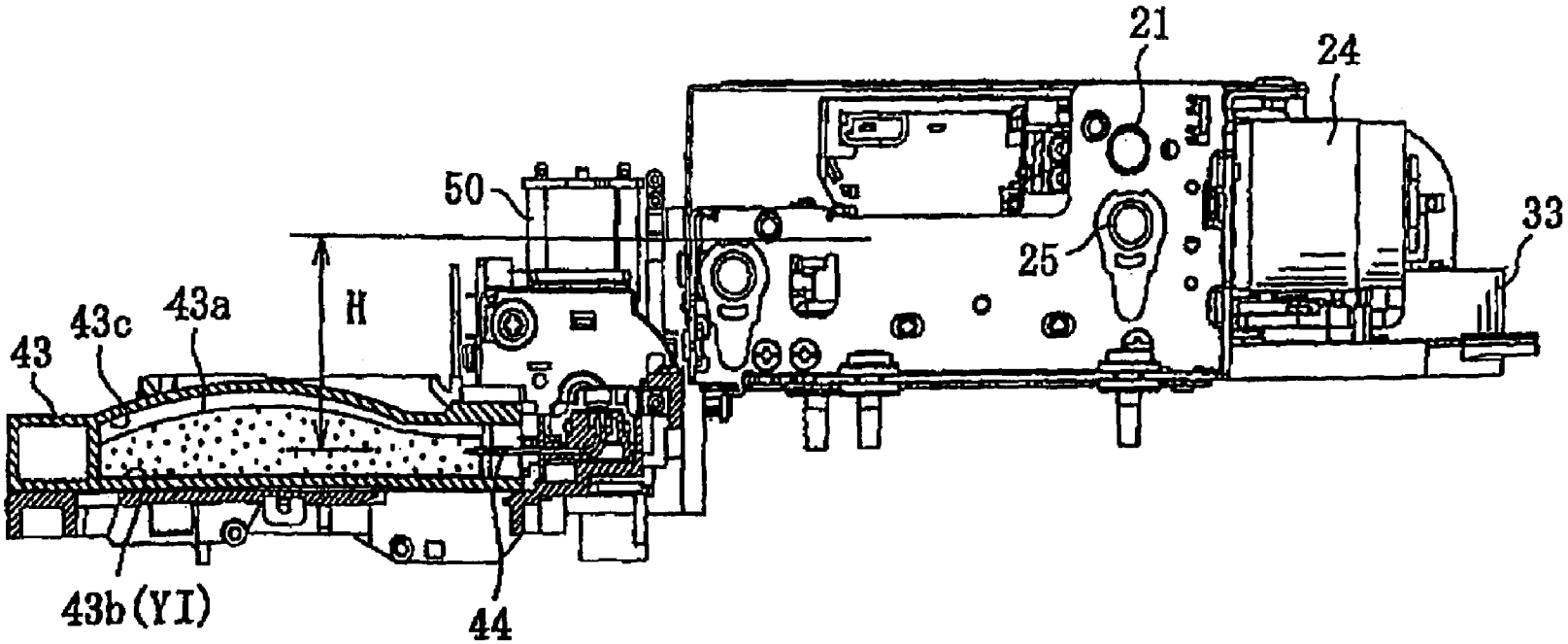
FIG. 3 a side view, partially in cross-section, of the inkjet printer shown in FIG. 2.

An ink cartridge of black ink 40, an ink cartridge of cyan ink 41, an ink cartridge of magenta ink 42 and an ink cartridge of yellow ink 43 are disposed in this order from the left side in the front side of the ink supply unit 12. As shown in FIGS. 2 and 3, in cartridge cases of the respective ink cartridges 40 to 43, flexible film members 40*a* to 43*a* are respectively set up generally all over the cases. Inside of the ink cartridges are respectively divided by these film members 40*a* to 43*a* into ink reservoirs 40*b* to 43*b* in the lower portions of the cartridges and air chambers 40*c* to 43*c* in the upper portion. The ink reservoirs 40*b* to 43*b* reserve respective colors of ink. Atmospheric air can flow in the air chambers 40*c* to 43*c*. Black ink BI, cyan ink CI, magenta ink MI and yellow ink YI are respectively reserved in the ink reservoirs 40*b* to 43*b* of the ink cartridges 40 to 43.

Figure 7:
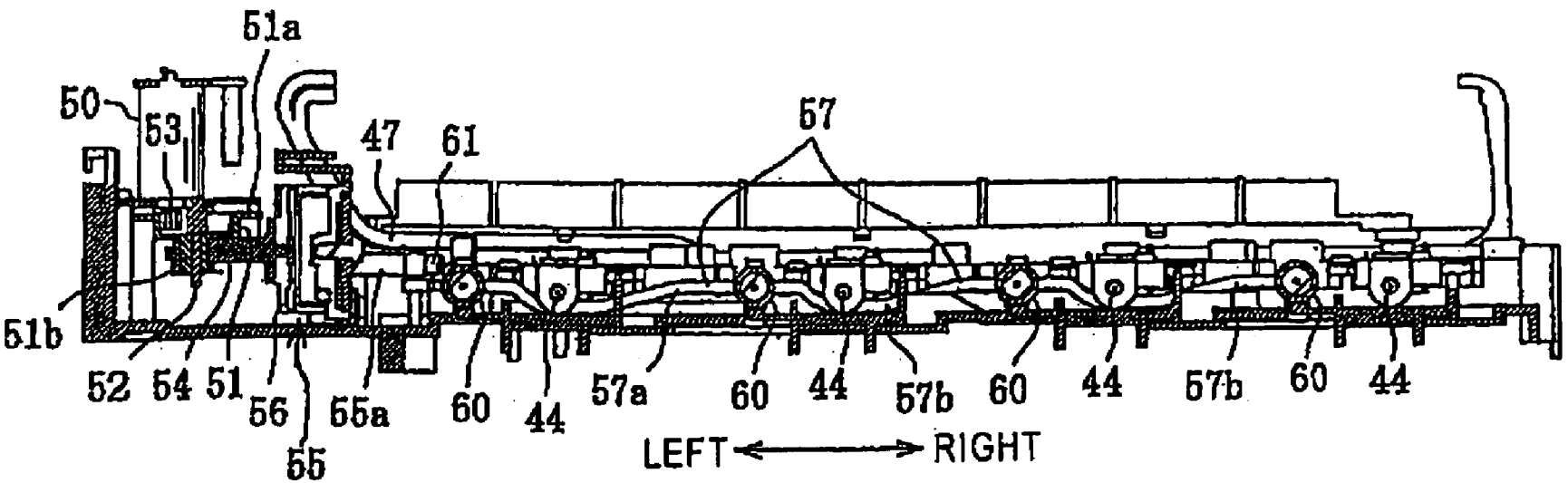
FIG. 7 is a cross-section view taken along VII—VII shown in FIG. 2.

As shown in FIGS. 2, 3 and 7, in the back side of mount portions on which the ink cartridges 40 to 43 are mounted, ink pins 44 are respectively disposed projecting anteriorly. The rear ends of the ink pins 44 are respectively connected to the printing head 23P through corresponding ink supply tubes 45 to 48. The ink supply tubes 45 and 46 are bundled together so that one rides on another from the mid portions thereof. The ink supply tubes 47 and 48 are bundled together likewise.

The printing head 23P is disposed higher than the ink cartridges 40 to 43 by head pressure difference H as shown in FIG. 3. When the ink cartridges 40 to 43 are respectively mounted on predetermined mount portions, the fore ends of the ink pins 44 are inserted into the rear end portions of the film members 40*a* to 43*a* and reach the ink reservoirs 40*b* to 43*b*. Respective inks BI, CI, MI and YI are supplied to the printing head 23P through corresponding ink supply tubes 45 to 48. Thereby, inks BI, CI, MI and YI are filled in the nozzles 23*n*, i.e. series of nozzles 23*a* to 23*d* of the printing head 23P through the ink supply tubes 45 to 48. Since negative pressure is generated owing to the head pressure difference H, a well-shaped meniscus curved toward inside of nozzle 23*n* is formed in each nozzle 23*n*.

The pressurized air supply unit (pressurized air generating device) 13 of the inkjet printer 4 is described by the following.

Figure 8:
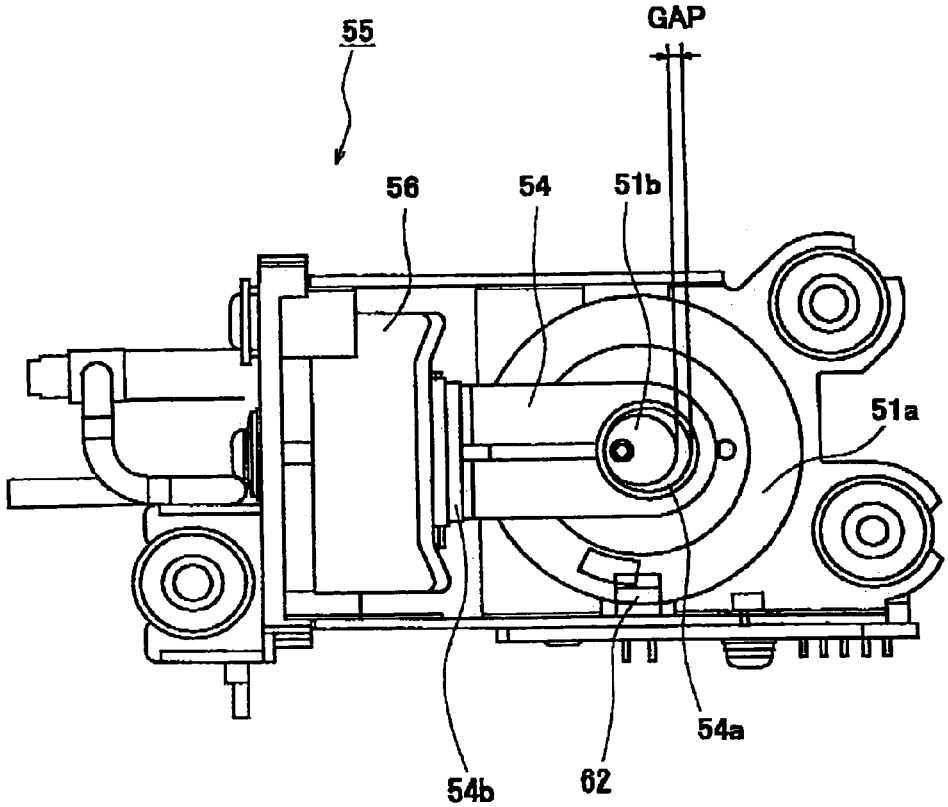
FIG. 8 is a schematic view showing the structure of the pressurized air supply unit of the embodiment.

As shown in FIGS. 2 and 7, a drive motor 50 which drives an air pump 55 constituted with a diaphragm pump is disposed in the left side of the ink cartridge 40. Under this drive motor 50, an internal gear 51 with a bottom wall is rotatably supported by a support shaft 52. A pinion gear 53 attached to the drive shaft of the drive motor 50 engages with the internal gear 51. On the bottom wall of the internal gear 51, an eccentric cam 51*b* is formed in an integrated manner. The ratio of cogs of the pinion gear 53 and the internal gear 51 is 1:4. The eccentric cam 51*b* is slidably fit into a connection hole 54*a* formed in the vicinity of the right end (the right end in FIG. 8) of a con-rod 54 as shown in FIG. 8 having a predetermined gap (GAP) therein. An end 54*b* of the con-rod 64 is connected to the diaphragm 56 of the air pump 55.

The con-rod 54 is formed long enough to enable its end 54*b* to push the diaphragm 56 approximately 1 to 2 mm leftward even when the con-rod 54 is in the most right side (the right side in FIG. 8) (in the position shown in FIG. 8). By the repulsive force of the pushed diaphragm 56, rightward force is given to the con-rod 54 and the eccentric cam 51*b* is pressed against the left side of the connection hole 54*a*. Hence, the GAP between the eccentric cam 51*b* and the wall of the connection hole 54*a* is formed in the right side of the connection hole 54*a*.

When the con-rod 54 is in other positions by rotations of the eccentric cam 51*b*, the con-rod 54 further pushes the diaphragm 56 to the left side. More repulsive force to the right side is given to the con-rod 54 and presses the eccentric cam 51*b* against the left side of the connection hole 54*a*. The GAP between the eccentric cam 51*b* and the wall of the connection hole 54*a* is formed likewise in the right side of the connection hole 54*a*. In short, the eccentric cam 51*b* is always pressed against the left side of the connection hole 54*a*, and the GAP between the eccentric cam 51*b* and the wall of the connection: hole 54*a* is always formed in the right side of the connection hole 54*a*.

Therefore, in the present embodiment, noise is not generated by the eccentric cam 51*b* hitting different parts of the connection hole 54*a* when the air pump is driven.

On the upper end of the internal gear 51, a flange 51*a* with one slit is formed integrally. An encoder 62 constituted with a photointerrupter is disposed to detect the slit of this flange 51*a* (refer to FIG. 11). In every four rotations of the drive motor 50, the air pump 55 makes one reciprocating movement. In one reciprocating movement of the air pump 55, one detection pulse signal is output from the encoder 62 to a control device 70.

Figure 11A:
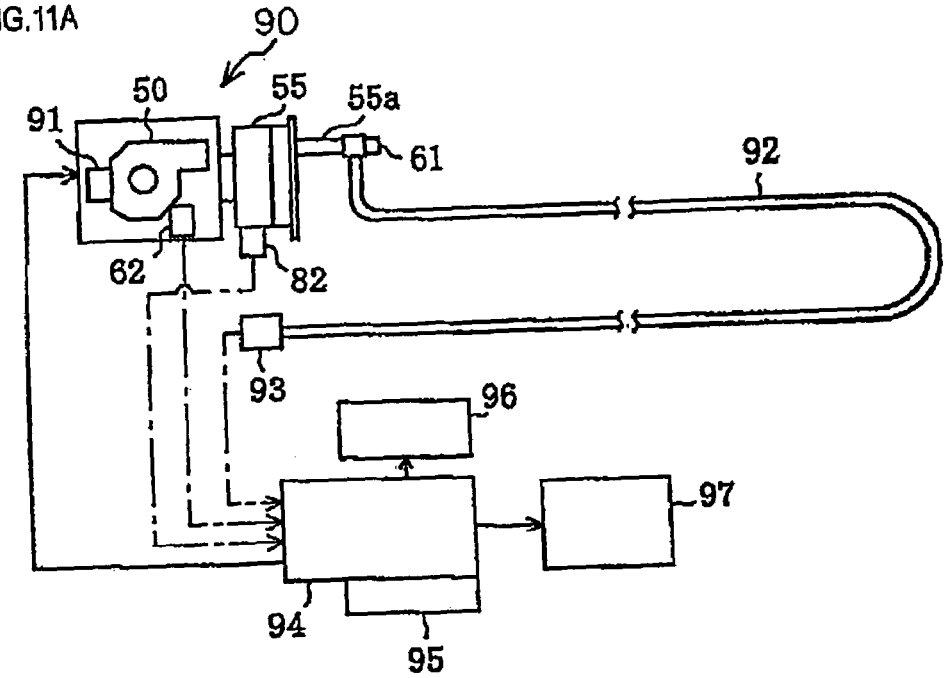
FIGS. 11 A to C are schematic views showing the structure of the pressurized air supply unit of the embodiment.

In the pressurized air supply unit 13, a thermistor 82 is disposed to detect the ambient temperature of the air pump 55 (refer to FIG. 11).

Figure 9:
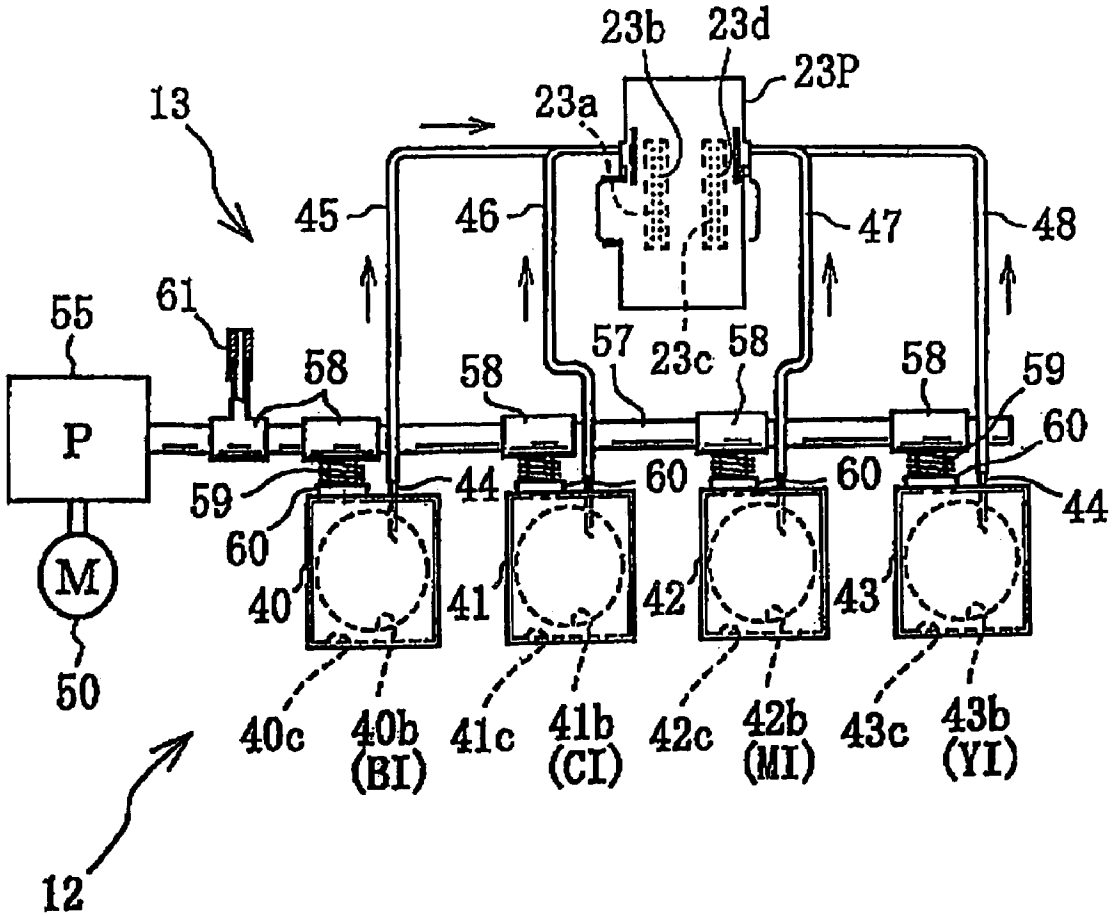
FIG. 9 is a schematic view showing the structure of the air supply system of the inkjet printer.

Inlet and outlet valves are disposed on the air pump 55 (not shown). As shown in FIGS. 7 and 9, a flexible air supply tube 57 (the internal diameter thereof is, for example, approximately 1 mm) is connected to a discharge tube 55*a* communicated with the outlet valve. Four branching members 58 are mounted on the air supply tube 57 with predetermined intervals. A pressure-bonded pad 60 resiliently biased by a coil spring 59 is mounted on a branching end of each branching member 58. A communication hole is disposed on each pressure-bonded pad 60 for air passage.

An orifice 61 is connected, as shown in FIG. 9, to the discharge tube 55*a* (refer to FIGS. 7 and 11) of the air pump 55 through one of the branching members 58. The orifice 61 has a narrowed path with an internal diameter which is adequately smaller than the internal diameter of the air supply tube 57 (e.g. approximately 0.5 mm). The orifice 61 is always communicated with atmospheric air through the narrowed path. Therefore, when the ink cartridges 40 to 43 are respectively mounted on predetermined mount portions, pressurized air supplied from the air pump 55 to the air supply tube 57 is supplied to the air chambers 40*c* to 43*c* of the ink cartridges 40 to 43 through the pressure-bonded pads 60.

As shown in FIG. 7, the air supply tube 57 which connects the branching members 58 is divided into an air supply tube 57*a* which connects the branching members 58 supplying the pressurized air to the black ink cartridge 40 and the cyan ink cartridge 41, and an air supply tube 57*b* which connects the branching members 58 supplying the pressurized air to the magenta ink cartridge 42 and the yellow ink cartridge 43. Since the width of the black ink cartridge 40 is wider than other ink cartridges 41 to 43, the air supply tube 57*a* is slightly longer than the air supply tube 57*b*. To avoid confusion in an assembly between the air supply tubes 57*a* and 57*b*, each tube is in a different color. For example, the air supply tube 57*a* is in blue, and the air supply tube 57*b* is in white. It helps an assembly in efficiency.

When the air pump 55 is not operated, the atmosphere pressure affects in the air chambers 40*c* to 43*c* through the air supply tube 57 and the orifice 61. When the drive motor 50 is driven and rotated in a maintenance process, the diaphragm 56 is reciprocated from side to side through the pinion gear 53, internal gear 51 and the eccentric cam 51*b*. Consequently, the air pump 55 is operated and generates pressurized air. The pressure of the pressurized air is P1 (approximately 180 mmAq) (in a high pressure mode) for an air discharge process, which is to be described hereinafter, and P2 (approximately 95 mmAq) (in a low pressure mode) for an ink vacuum process. Both pressures are set on some values so as not to destroy meniscuses.

When the pressurized air affects the air chambers 40*c* to 43*c* of the ink cartridges 40 to 43 in the ink vacuum process, the pressurized air counteracts the negative pressure given by the head pressure difference H. Hence, the ink is inflated from the fore end of each nozzle (refer to FIGS. 10B to 10D). The pressurized air generated by the air pump 55 is discharged from the orifice 61 in order for the pressure to be adjusted. The air pressure in the air supply tube 57 is set according to the rotational speed of the drive motor 50 and the atmospheric temperature.

Figure 11B:
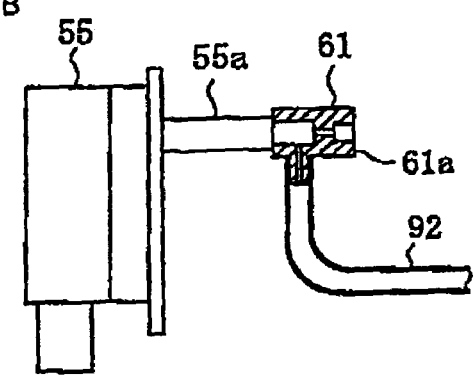
Figure 11C:
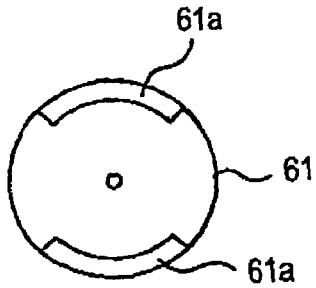

As shown in FIG. 11B, the orifice 61 is a horizontal hole having eaves 61*a* to proof the orifice 61 against dirt, dust and contamination caused in an operation. The eaves 61*a* are formed on the top and bottom surfaces of the orifice 61 and the lateral portions thereof are cut off as shown in FIG. 11C illustrating the orifice 61 from the front (from the right side of FIG. 11B). Owing to the cut-off portions, the orifice 61 does not get blocked even when something presses against the front surface thereof. Moreover, the eave 61*a* covering the top surface of the orifice 61 can prevent a blockage in the outlet of the orifice 61 by dirt or dust falling thereon.

Thirdly, the following describes the control system of the multi-function apparatus 1.

Figure 12:
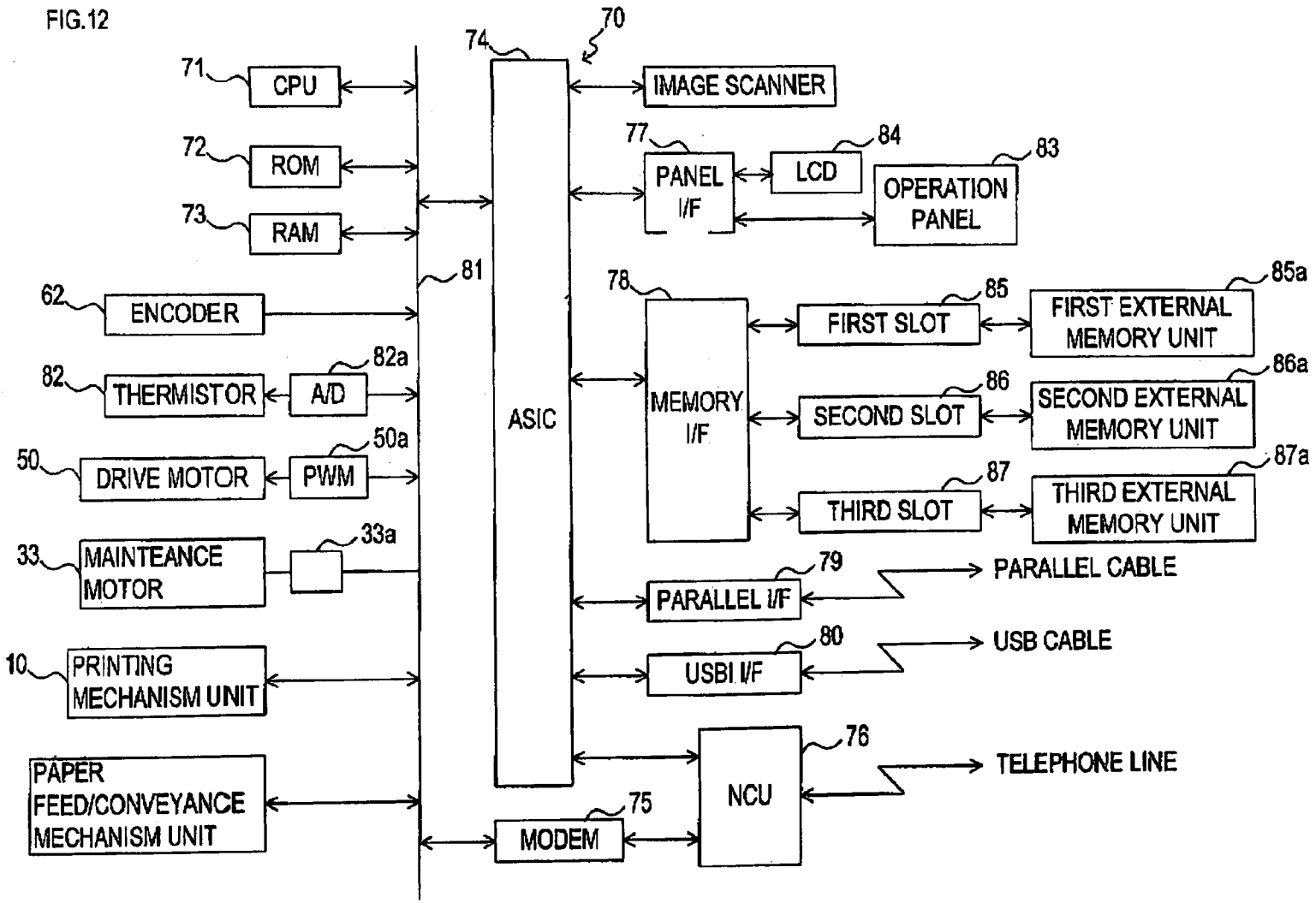
FIG. 12 is a schematic view showing the structure of the control system of the embodiment.

As shown in FIG. 12, the control device 70 of the multi-function apparatus 1 comprises a computer including. CPU 71, ROM 72 and RAM 73; an ASIC (Application Specified Integrated Circuit) 74; a modem 75 and a NCU (Network Control Unit) 76 to communicate with outside by a telephone line; a panel interface 77; a memory interface 78; a parallel interface 79; USB interface 80; and a bus 81 for data transmission. These constituents of the control device 70 are respectively connected with target devices. Various control programs to achieve aforementioned functions of the multi-function apparatus 1 are stored in the ROM 71. The RAM 72 is backed up by a secondary battery and maintains stored information.

The maintenance motor 33 of the maintenance mechanism unit 11 is connected to the bus 81 through a drive circuit 33*a*. The pump drive motor (DC motor) 50 of the pressurized air generating mechanism is connected with the bus 81 through the drive circuit 50*a* which controls the motor speed with PWM (Pulse Width Modulation). A thermistor 82 which detects the ambient temperature of the air pump 55 is connected with the bus 81 through an A/D converter 82*a*. The encoder 62 which detects the reciprocating movement of the air pump 55 is connected with the bus 81.

An operation panel 83 of the multi-function apparatus 1 and the LCD (Liquid Crystal Display) 84 thereof are connected to the panel interface 77. First, second and third slots 86 to 87 are connected to the memory interface 78. To the first, second and third slots 86 to 87, first, second and third external memory units 85*a* to 87*a*, such as Compact FlashR, SmartmediaR and Memory StickR are to be inserted detachably. A parallel cable for data transmission is connected to the parallel interface 79. A USB cable for data transmission is connected to the USB interface 80.

Fourthly, the following outlines the process of vacuuming ink from the printing head 28P (ink vacuum process) conducted by the maintenance mechanism unit 11 of the inkjet printer 4.

When four ink cartridges 40 to 43 are respectively mounted on predetermined positions shown in FIG. 2, the fore end of the ink pins 44 are inserted through the rear ends of the film members 40*a* to 43*a* and reach the ink reservoirs 40*b* to 43*b*. The inks BI, CI, MI and YI in the ink reservoirs 40*b* to 43*b* are supplied to the printing head 23P through respective ink supply tubes 45 to 48, and filled in each nozzle 23*n* of series of nozzles 23*a* to 23*d* of the printing head 22P.

Figure 10A:
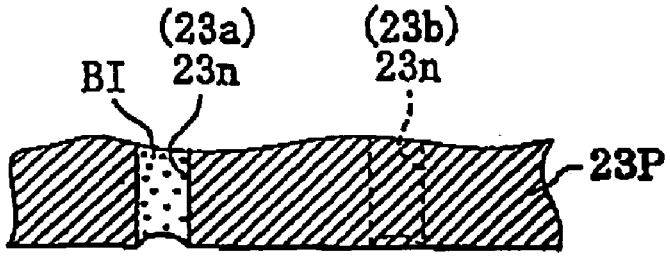
FIGS. 10 A to E are schematic views showing the print head of the inkjet printer.

As shown in FIG. 10A, at the fore end of each nozzle 23*n*, a meniscus which is curving toward inside the nozzle and suitable for printing is formed by the negative pressure generated by the head pressure difference H. It should be noted that, in FIG. 10, only one nozzle 23*n* each is illustrated from the series of nozzles 23*a* and 28*b*.

In order to operate the ink vacuum process, the printing head 23P is shifted to a maintenance position shown in FIG. 2. Subsequently, the maintenance motor a3 is normally rotated in the clockwise direction to raise the head caps 32 to an operational position so that the head caps 32 cover the printing head 23P tightly.

Then, the pump drive motor 50 is driven. When the air pump 56 is driven, pressurized air pressurized at predetermined pressure P2 (approximately 95 mmAq) by the air pump 55 affects the air chambers 40*c* to 43*c* of the respective ink cartridges 40 to 43 through the air supply tube 57. The air pressure P2 is lower than the air pressure P1 of the air discharge process, which is to be described hereinafter. The pressurized air supply unit 13 is in the low pressure mode After predetermined period of time (for example, 5 seconds) passes, the air pressure P2 of the pressurized air affects the inks BI, CI, MI and YI in the ink reservoirs 40*b* to 43*b*. The ink become inflated (the status of completion of pressure purge) from the respective fore ends of the nozzles 23*n* of series of nozzles 23*a* to 23*d*. In this status, the ink can be vacuumed from the nozzles 23*n* by rotating the maintenance motor 33 reversely to operate the vacuum pump 200. Thereby, the ink vacuum process can be conducted while the pressure in the head caps 32 is not negative.

Figure 10B:
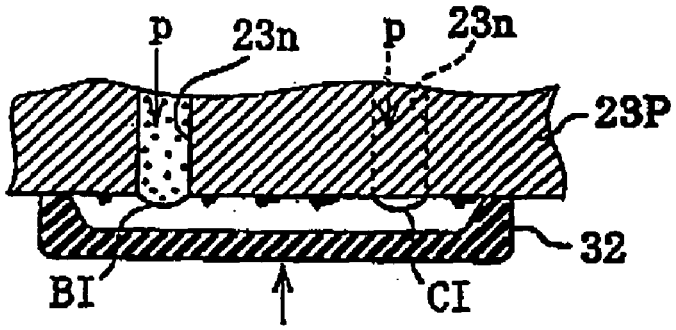
Figure 10C:
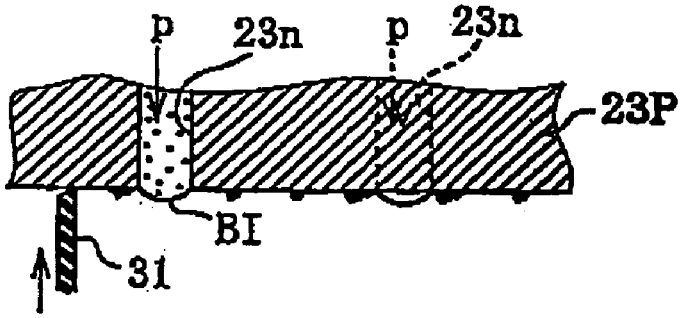

After predetermined period of time passes, the maintenance motor 33 is rotated normally to remove the tightly covered head caps 32 from the printing head 23P and to raise the wiper blade 31 to the operational position as shown in FIG. 10C.

Figure 10D:
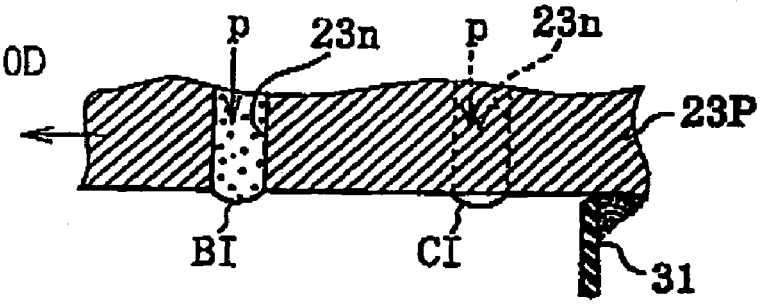

When this operation is conducted, the pressure in the head caps 32 is not negative. Thus, neither ink of other colors adhered around the nozzles 23*n* nor air enters the nozzle 23*n*. This can surely prevent mixture of colors and missing colors when printing is conducted. In this status, the printing head 23P is shifted leftward as shown in FIG. 10D and a wipe-out on the head surface of the printing head 23P is conducted by the wiper blade 31. Consequently, the maintenance motor 33 is driven to lower the wiper blade 31 to a standby position, and the drive of the pump motor 50 is stopped.

Figure 10E:
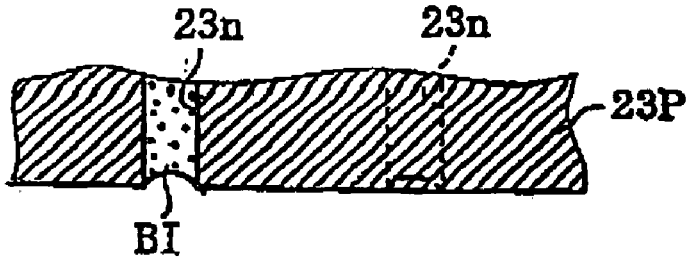

The pressurized air still affects in the nozzles 23*n* when the wipe-out by the wiper blade 31 is conducted. Thus, the ink wiped out by the wiper blade 31 does not enter other nozzles 23*n*. When the air pressure of the pressurized air affecting each nozzle 23*n* is eliminated, a meniscus which is curved toward inside the nozzle 23*n* and suitable for printing is formed at each nozzle 23*n* as shown in FIG. 10E. After this maintenance process is completed, a printing process is executed corresponding to printing data. Color images are finely printed on paper fed from the paper feeder 2.

As described above, pressurized air at air pressure P2 generated by the air pump 55 affects each nozzle 23*n* when the ink vacuum process is conducted as a maintenance process. Therefore, when a printing is conducted after the ink vacuum process, mixture of colors and missing colors can be inhibited.

Fifthly, the following outlines the process to discharge accumulated air in the ink supply tubes 45 to 48 and the printing head 23P (the air discharge process) conducted by the maintenance mechanism unit 11 of the inkjet printer 4.

For the air discharge process, the printing head 23P is firstly shifted to the maintenance position shown in FIG. 2. Consequently the air pump. 55 is driven. The pressurized air pressurized at predetermined pressure P1 (approximately 180 mmAq) is supplied from the air pump 55 to the air chambers 40*c* to 43*c* of the ink cartridges 40 to 43 through the air supply tube 57. The air pressure P1 is higher than the air pressure P2 for the ink vacuum process. The pressurized air supply unit 13 in the high pressure mode.

After predetermined period of time (for example, 5 seconds) passes, the air pressure P1 of the pressurized air affects the inks BI, CI, MI and YI in the ink reservoirs 40*b* to 43*b*. The supply paths of respective inks in the inkjet head 23P are also pressurized.

Consequently, the maintenance motor 33 is rotated normally to raise the release rods 34*a*1 to a4 of the maintenance mechanism unit 11. The valve rods 28*c*1 to c4 are correspondingly pushed up. The upper portions 28*d*1 to d4 of the shut-off valves 28*b*1 to b4 are also pushed up. Gaps are made between the upper portions 28*d*1 to d4 and the lower portions 28*f*1 to f4 of the shut-off valves 28*b*1 to b4 to open the air discharge tubes 28*a*1 to a4 (refer to FIG. 6).

Hereupon, accumulated air in the ink supply paths of the inkjet head 23P which is pressurized by the pressurized air is discharged through the air discharge tubes 28*a*1 to a4.

In this status, the maintenance motor 38 is rotated reversely to rotate the vacuum pump 200 intermittently having, for example, one second of idle period for every rotation. The ink which has leaked and gone through the air discharge tubes 28*a*1 to a4 with the accumulated air are vacuumed by the vacuum pump 200 through the switching valve 201.

When an air discharge is completed, the maintenance motor 33 is once again rotated normally predetermined number of times to lower the release rods 34*a*1 to a4. The upper portions 28*d*1 to d4 of the shut-off valves 28*b*1 to b4 are consequently pushed downward by the springs 28*e*1 to e4. By the upper portions 28*d*1 to d4 being pressed against the lower portions 28*f*1 to f4, the shut-off valves 28*b*1 to b4 are closed.

The air pump 55 is stopped to terminate the pressurizing on the ink supply path of each color.

Figure 13:
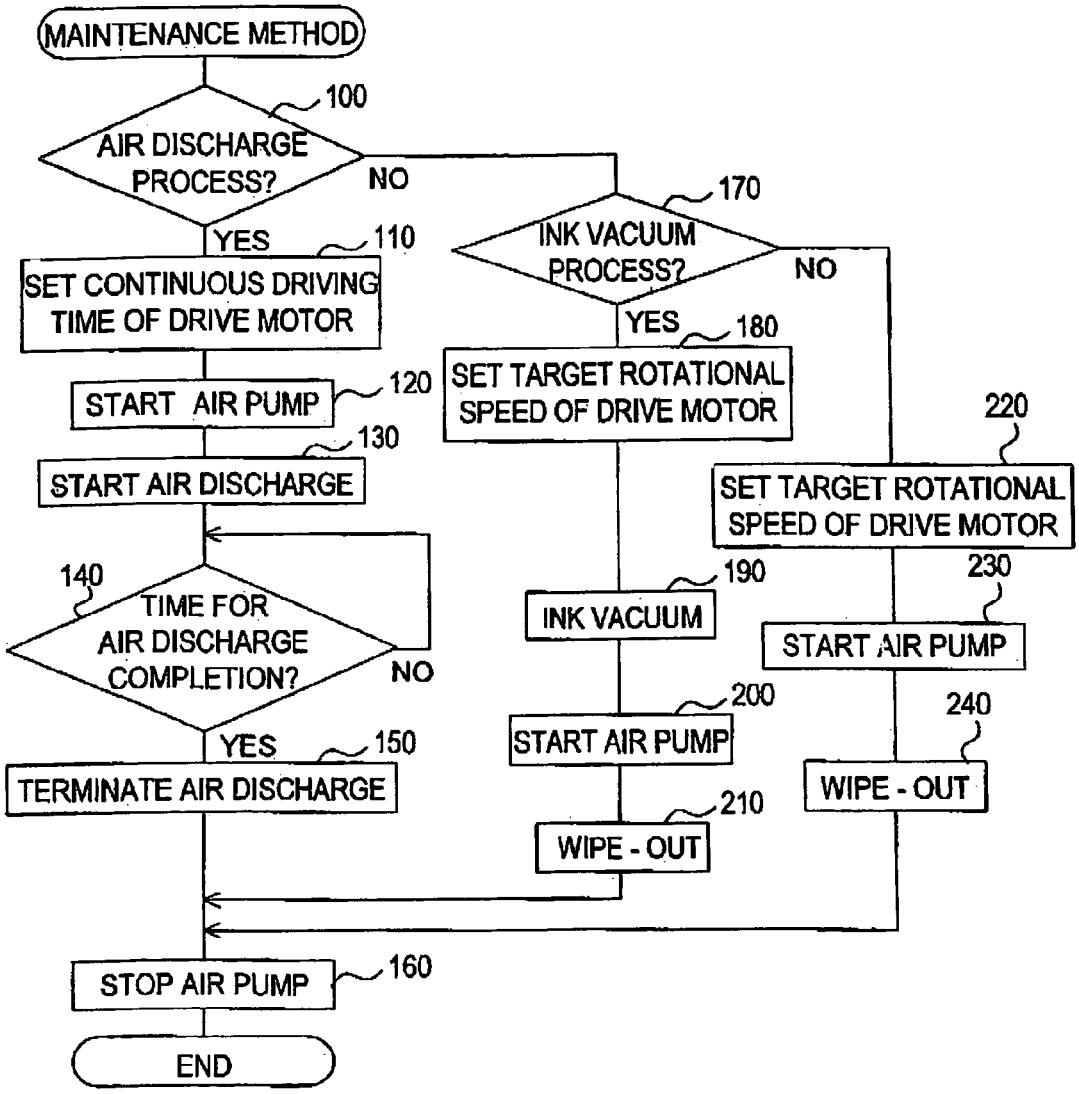
FIG. 13 is a flowchart showing processes of the inkjet printer of the embodiment.
Figure 14:
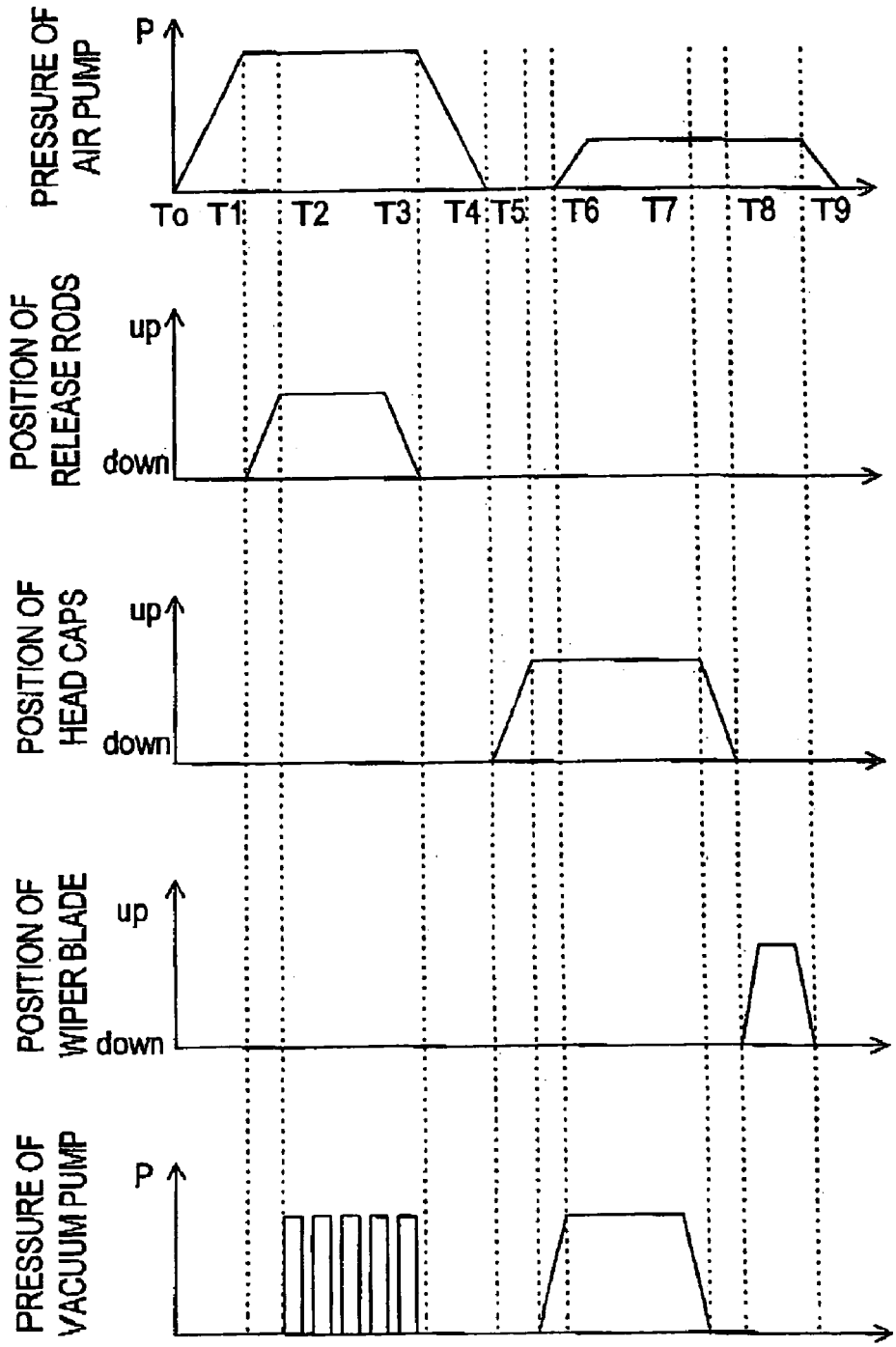
FIG. 14 is an operation sequence chart showing operations of the inkjet printer of the embodiment.

Sixthly, the following describes the process of the maintenance method conducted by the inkjet printer 4 of the present embodiment referring to the flowchart of FIG. 13 and the operation sequence chart of FIG. 14. The operation sequence chart of FIG. 14 shows the sequence when the air discharge process of Step 110 to 160 which is to be described hereinafter and the ink vacuum process of Step 170 to 210 are continuously conducted.

Prior to the maintenance process (for example, before the air pump 55 is installed in the inkjet printer 4), the capability of the air pump 55 needs to be obtained. To be more precise, the correlative characteristic of the air pump 55 which shows the correlation between the rotational speed of the drive motor 50 and the air pressure generated by the air pump 55 needs to be obtained.

The correlative characteristic with temperature which shows the correlation between the ambient temperature of the air pump 55 and the capability of the air pump 55 also needs to be obtained prior to the maintenance process. To be more precise, the correlative characteristic with temperature shows the correlation between the ambient temperature of the air pump 55 and air pressure generated by a standard air pump (which is the same type of pump as the air pump 55 and has an average capability) when the drive motor 50 is driven at predetermined rotational speed (the rotational speed used in the air discharge process) for predetermined period of time.

In Step 100 of the maintenance process, it is determined whether or not the air discharge process is to be conducted. Specifically, when a user enters a prosecution of the air discharge process with the operation panel 83, a positive determination is provided, i.e. the air discharge process is determined to be conducted (YES), and the process goes to Step 110. On the other hand, when the user does not enter a prosecution of the air discharge process with the operation panel 83, a negative determination is provided, i.e. the air discharge process is not determined to be conducted (NO), and the process goes to Step 170.

In Step 100, a positive determination can also be provided when predetermined conditions are met. For example, when certain period of time, e.g. one month, has passed since the prosecution of last air discharge process, a positive determination can be provided. A negative determination can be provided when the predetermined conditions are not met.

In Step 110, the continuous driving time, i.e. the time to drive the drive motor 50 continuously, is set according to the capability and the ambient temperature of the air pump 55 in order for the amount of discharged air to be certain amount in the air discharge process.

Specifically, by applying the capability of the air pump 55 actually installed in the inkjet printer 4 to the correlative characteristic of the air pump 55 obtained previously, the air pressure generated by the air pump 55 when the drive motor 50 is driven at predetermined rotational speed (for example, at the rotational speed which is to generate the air pressure P1 at standard temperature, e.g. 25° C. with a standard air pump) is calculated. The continuous driving time of the drive motor 50 required for discharging predetermined amount of air (e.g. 0.15 cc) with the air pressure obtained above is estimated. A calibration curve between the air pressure and the continuous driving time required to discharge predetermined amount of air, for example, can be prepared in advance and used for these calculations.

Since the estimated continuous driving time calculated as above is obtained under the predetermined temperature (the temperature used to obtain the correlative characteristic of the air pump 55), a correction is necessary based on the ambient temperature of the air pump 55. Specifically, the temperature in the vicinity of the air pump 55 detected by the thermistor 82 is applied to the correlative characteristic with temperature previously obtained in order to obtain variation in the air pressure generated by the air pump 55 in comparison with the value obtained with the predetermined temperature. According to the range of the variation, a correction can be done. For example, if the air pressure decreases because of the influence of the temperature, the continuous driving time is corrected to be longer. Adversely, if the air pressure increases, the continuous driving time is corrected to be shorter.

In Step 120, the drive of the drive motor 50 is initiated at time T0 (FIG. 14), and air supply by the air pump 55 is initiated. The air chambers 40*c* to 43*c* of the respective ink cartridges 40 to 43 are expanded. Consequently, the ink supply paths in the ink reservoirs 40*b* to 43*b*, and furthermore in the inkjet head 23 are pressurized. At time T1, the pressure in the ink supply paths reaches the certain pressure (P1). The pressure P1 is higher than the pressure P2, which is to be described, for the ink vacuum process. The pressurized air supply unit 13 is in the high pressure mode.

The rotational speed of the drive motor 50 in Step 120 is the rotational speed previously set for the air discharge (the rotational speed for the air discharge). It is fixed at the highest rotational speed as possible for the level of noise generated by the air pump 55 when the air pump 55 is driven at this rotational speed to be lower than the permissible level in the usage environment.

In Step 130, the printing head 23P is shifted to the maintenance position shown in FIG. 2, and an air discharge of accumulated air in the ink supply paths is initiated. Specifically, between time T1 and T2, the release rods 34*a*1 to a4 of the maintenance mechanism unit 11 are raised to open the shut-off valves 28*b*1 to b4 of the air discharge tubes 28*a*1 to a4.

Since the ink supply paths of the inkjet head 23P are already pressurized in Step 120, the air accumulated in the ink supply paths of the inkjet head 23P is discharged from the air discharge tubes 28*a*1 to a4 (refer to FIG. 5).

In Step 140, it is determined whether or not predetermined time has passed since the initiation of the air discharge in Step 130. If it is determined YES, the process goes to the Step 150. If it is determined NO, the process stays in Step 140.

In Step 150, the air discharge from the inkjet head 23P is terminated. That is, at time T3, the release rods 34*a*1 to a4 of the maintenance mechanism unit 11 are lowered to close the shut-off valves 28*b*1 to b4 of the air discharge tubes 28*a*1 a4 (refer to FIG. 5).

In Step 160, at time T3, the drive motor 50 is stopped to terminate the air supply from the air pump 55. In short, the pressurizing on the ink supply paths is stopped. Thereby, the pressure given to the ink supply paths becomes 0 at time T4. It should be noted that Steps 110 to 160 are steps of the air discharge process.

Meanwhile, when it is determined NO in Step 100, the process proceeds to Step 170. In Step 170, it is determined whether or not the ink vacuum process is to be conducted.

Specifically, when a user enters a prosecution of the ink vacuum process with the operation panel 83, it is determined to be a positive determination (YES), and the process proceeds to Step 180. On the other hand, when the user does not enter a prosecution of the ink vacuum process with the operation panel 83, it is determined to be a negative determination (NO), and the process proceeds to Step 220.

Alternatively in Step 170, a positive determination can be also given when predetermined conditions (for example, the inkjet printer 4 has not been used for certain period of time) are met. A negative determination can be given when the predetermined conditions are not met.

In Step 180, the rotational speed per unit time of drive motor 50 is set based on the capability and the ambient temperature of the air pump 55 so that the air pressure generated by the air pump 55 stabilizes at pressure P2 in the ink vacuum process. The target pressure P2 is lower than air pressure P1 generated in the air discharge process. The pressure P2 is equivalent to the air pressure of the low pressure mode.

Specifically, by applying the air pressure which is desired to be generated (P2) by the air pump 55 actually installed in the inkjet printer 4 to the correlative characteristic of air pump previously obtained, rotational speed of the drive motor 50 required to generate the air pressure P2 is estimated.

Since the rotational speed estimated as above is a value obtained under the predetermined temperature (the temperature used to obtain the correlative characteristic of the air pump), a correction is required based on the ambient temperature of the air pump 55. Specifically, by applying the temperature in the vicinity of the air pump 55 detected by the thermistor 82 to the correlative characteristic with temperature obtained previously in order to obtain the variation of the air pressure generated by the air pump 55 in a comparison with the air pressure obtained with the predetermined temperature. The rotational speed is corrected according to the rage of the variation. For example, if the air pressure decreases by the influence of the temperature, the rotational speed is corrected to be higher. Adversely, if the air pressure increases, the rotational speed is corrected to be lower.

In Step 190, the printing head 23P is shifted to the maintenance position shown in FIG. 2. Between time T4 and T5, the head caps 32 of the maintenance mechanism unit 11 are raised to tightly cover the printing head 23P as shown in FIG. 10B. At time T5, an ink vacuum from each nozzle 23*n* is initiated by the vacuum pump 200. The negative pressure given by the vacuum pump 200 reaches a certain pressure at time T6.

In Step 200, the drive of the drive motor 50 is initiated with the rotational speed set in Step 180 at time T6 to initiate air supply by the air pump 55. Subsequently, the air chambers 40*c* to 43*c* of the ink cartridges 40 to 48 are respectively expanded. The ink reservoirs 40*b* to 48*b* and the ink supply paths in the inkjet head 23P are sequentially pressurized.

At time T7, the vacuum by the vacuum pump 200 is stopped. Between time T7 to T8, the head caps 32 are lowered to be separated from the printing head 23P.

In Step 210, between time T8 to T9, the printing head 28P is shifted leftward from the maintenance position and the head surface thereof is wiped out by the wiper blade 31 (refer to FIG. 10D). Afterward, the wiper blade 31 is lowered to the standby position.

The supply of pressurized air conducted by the air pump 55 and initiated in Step 120 is stopped at time T9.

The processes of Steps 180 to 210 and 160 are processes of the ink vacuum process.

Meanwhile, when it is determined NO in Step 170, the process proceeds to Step 220. In Step 220, the rotational speed of the drive motor 50 is set in the same way as Step 180.

In Step 230, the air supply by the air pump 55 is initiated in the same manner as Step 200.

In Step 240, the head surface of the printing head 23P is wiped out by the wiper blade 31 in the same manner as Step 210.

Lastly, the following describes the effects achieved by the inkjet printer 4 and the maintenance method of the present embodiment.

In the present embodiment, the air pressure P2 generated by the air pump 55 in the ink vacuum process is set lower than the air pressure P1 generated by the air pump 55 in the air discharge process.

This enables the air pressure to be set most appropriately, respectively for the air discharge process wherein high air pressure is required and for the ink vacuum process wherein lower air pressure is suitable.

In other words, the disadvantages, such as an insufficient air discharge of the accumulated air in the ink supply paths or excessive time required for an air discharge because of the air pressure being too low for the air discharge process, are not created in contrast with a maintenance method wherein air pressure is the same for both processes.

Furthermore, unnecessary ink leakage from the printing head 23P because of the air pressure being too high does not occur in the ink vacuum process.

In the present embodiment, the operational time of the air pump 55 is controlled in the air discharge process according to the ambient temperature and the capability of the air pump 55. The amount of air discharged from the ink supply paths of the printing head 23P in the air discharge process can be the same even if the temperature changes or the capabilities of air pumps installed as the air pump 55 differ from one to another.

Thereby, an insufficient air discharge from the printing head 23P or a leakage of large amount of ink along with air owing to too much discharged air does not occur.

In the present embodiment, the rotational speed of the drive pump 50 which drives the air pump 55 is set at a predetermined speed in the air discharge process. In this way, the rotational speed of the drive motor 50 does not become excessive, while the rotational speed of the drive motor 50 becomes excessive in a maintenance method wherein the rotational speed of the drive motor 50 is changed according to the ambient temperature or the capability of the air pump 55. As a result, this can reduce noise generated by the drive motor 50.

In the present embodiment, the rotational speed of the drive motor 50 is set in the ink vacuum process so that the air pressure generated by the air pump 56 stabilized at air pressure P2.

Thereby, when the ink supply paths are pressurized at the air pressure P2 in the ink vacuum process, the ink is reasonably inflated from the nozzles 23*n* of the printing head 23P as shown in FIGS. 10B to 10D.

In case of a maintenance method wherein the air pressure generated by the air pump 55 is not adjusted, air pressure is not enough to inflate the ink from the nozzles 23*n* or so excessive that a large amount of ink leaks from the nozzle 23*n*. However, this does not occur here.

Therefore, in the present embodiment, the bottom surface of the printing head 23P can be cleaned appropriately and blockage of nozzles 23*n* and unnecessary ink leakage can be prevented.

In the present embodiment, at time T7 in the ink vacuum process when an ink vacuum is terminated, a pressurizing by the air pump 55 on the ink supply paths is still continued (refer to FIG. 14). This can avoid the ink entering the nozzles 23*n* of the printing head. 28P when the head caps 32 are separated from the printing head 23P after a termination of an ink vacuum. That is, the ink does not disappear from the vicinity of the outlets of the nozzles 23*n* when the head caps 32 are separated from the printing head 23P after a termination of an ink vacuum. Therefore, printing can be always conducted properly after a prosecution of the ink vacuum process.

Between time T8 to T9 when the wiper blade 31 conducts a wipe-out, the pressurizing by the air pump 55 on the ink supply paths is continued (refer to FIG. 14). This can prevent inks of other colors adhered around the nozzles 23*n* or air entering the nozzles 23*n*. Mixture of colors and missing colors in printing can be inhibited.

In the present embodiment, at time T1 in the air discharge process when an air discharge is initiated to empty the air discharge tubes 28*a*1 to a4 (when the air discharge device is initiated), the air pump 55 of the pressurized air supply unit 13 (the pressurized air generating device) is already pressurizing the ink supply paths (refer to FIG. 14).

This can prevent air entering the printing head 28P from outside, or the ink mixed with other colors and discharged once from the printing head 2P to the air discharge tubes 28*a*1 to a4 going back to the printing head 23P.

Hence, contamination of the ink does not occur in the air discharge process of the present embodiment.

In the present embodiment, in the pressurized air supply unit 13, there is only one slit disposed on the flange 51*a* of the internal gear 51 disposed under the drive motor 50 (refer to FIG. 8). Thereby the encoder 62 outputs a pulse signal only one time in one reciprocating movement of the air pump 55. The pulsation range of the air pressure generated by the air pump 55 (variation range of the air pressure in one cycle) can be small.

In other words, if there are plural slits on the flanges 51*a* and the encoder 62 outputs plural signals in one reciprocating movement of the air pump 55, the speed of the drive motor 50 stays at a constant speed during one reciprocating movement of the air pump 55 since these plural signal are used to control the rotation of the drive motor 50. When the con-rod 54 pushes the air pump 55 in this situation, the air pressure generated by the air pump 55 becomes high in pulsing manner.

In contrast with the above-described case, when there is only one slit on the flange 51*a* and the encoder 62 outputs only one signal in one reciprocating movement of the air pump 55, in the same manner as the present embodiment, the speed of the drive motor 50 in one reciprocating movement of the air pump 55 varies. When a load on the air pump 55 is large (when the con-rod 54 pushes the air pump 55), the speed of the drive motor 50 slows down. When the load on the air pump 55 is small (when the con-rod 54 is not pushing the air pump 55), the speed of the drive motor 50 speeds up.

Since the speed of the drive motor 50 slows down, in the present embodiment, when the air pressure is generated (when the con-rod 54 pushes the air pump 55), the maximum value of the pulse of the air pressure generated at that time becomes small. Therefore, the fluctuation of the pulse of the air pressure generated by the air pump 55 can be small in the present embodiment.

Furthermore, the position of the slit is set, as shown in FIG. 8, so that the load on the phase of the eccentric cam 51*b* becomes the smallest. Fluctuations in the speed for each rotation can be the least as possible. Consequently, the air pressure can be stabilized.

Therefore, in the present embodiment, the ink does not leak from the nozzles 23*n* of the printing head 23 or does not enter the nozzles 23*n* because of the pulsation of the air pressure.

It should be noted that the present invention is not limited to the above-described embodiment, and that other modifications and variations are possible within the scope of the present invention.

What is claimed is:

1. An inkjet printer comprising:

ink cartridges which reserve ink supplied to an inkjet head;

a pressurized air generating device which generates pressurized air supplied to the ink cartridges;

an air discharge device which discharges air accumulated in supplying paths of the ink with the pressurized air; and an ink vacuum device which vacuums the ink from the inkjet head, wherein:

the pressurized air generating device comprises a high pressure mode to generate pressurized air at predetermined pressure P1 and a low pressure mode to generate pressurized air at pressure P2 which is lower than the pressure P1, the pressurized air generating device is adapted to be in the high pressure mode when the air discharge device is used, and the pressurized air generating device is adapted to be in the low pressure mode to pressurize the ink when the ink vacuum device is used, and the ink is pressurized by the pressurized air generating device at least by a time when a vacuum of the ink is terminated in a usage of the ink vacuum device.

2. The inkjet printer as set forth in claim 1, wherein the air discharge device is adapted to be used while the pressurized air generating device is operated.

3. The inkjet printer as set forth in claim 1, wherein the pressurized air generating device is constituted with an air pump and a drive motor which drives the air pump, and wherein rotational speed of the drive motor is kept at a constant speed and driving time of the drive motor is controlled according to capability of the air pump when the air discharge device is used.

4. The inkjet printer as set forth in claim 3, wherein the capability of the air pump is determined based on a correlative characteristic between the rotational speed of the drive motor and the air pressure generated by the air pump.

5. The inkjet printer as set forth in claim 3, wherein the driving time is further controlled according to ambient temperature of the air pump.

6. The inkjet printer as set forth in claim 3, wherein the rotational speed of the drive motor is controlled according to the capability of the air pump when the ink vacuum device is used.

7. The inkjet printer as set forth in claim 6, wherein the capability of the air pump is determined based on the correlative characteristic between the rotational speed of the drive motor and the air pressure generated by the air pump.

8. The inkjet printer as set forth in claim 6, wherein the rotational speed is further controlled according to the ambient temperature of the air pump.

9. The inkjet printer as set forth in claim 1, wherein a wiping operation is performed after the vacuum of the ink is terminated and while the ink is pressurized by the pressurized air generating device in the usage of the ink vacuum device.

10. The inkjet printer as set forth in claim 1, wherein pressurization of the ink is terminated when a predetermined time period has elapsed since the vacuum of the ink is terminated.

11. A maintenance method of inkjet printer comprising the steps of:

discharging air accumulated in ink supply paths of an inkjet printer with a pressurized air generating device constituted with an air pump and a drive motor which drives the air pump; and vacuuming the ink from an inkjet head of the inkjet printer, wherein:

pressure of pressurized air generated by the pressurized air generating device is set at predetermined pressure P1 when an air discharge process is conducted, is set at pressure P2 which is lower than the pressure P1 to pressurize the ink when an ink vacuum process is conducted, and the ink is pressurized by the pressurized air generating device at least by a time when a vacuum of the ink is terminated.

12. The maintenance method of inkjet printer as set forth in claim 11, wherein, in the air discharging step, rotational speed of the drive motor is kept at a constant speed and driving time of the drive motor is controlled according to capability of the air pump.

13. The maintenance method of inkjet printer as set forth in claim 12, wherein the driving time is further controlled according to ambient temperature of the air pump.

14. The maintenance method of inkjet printer as set forth in claim 11, wherein, in the ink vacuuming step, the rotational speed of the drive motor is controlled according to the capability of the air pump.

15. The maintenance method of inkjet printer as set forth in claim 14, wherein the rotational speed is further controlled according to the ambient temperature of the air pump.

16. The maintenance method of inkjet printer as set forth in claim 11, wherein a wiping operation is performed after the vacuum of the ink is terminated and while the ink is pressurized by the pressurized air generating device.

17. The maintenance method of inkjet printer as set forth in claim 11, wherein pressurization of the ink is terminated when a predetermined time period has elapsed since the vacuum of the ink is terminated.

* * * * *